United States Patent [19]

Bychowski

[11] 3,945,568

[45] Mar. 23, 1976

[54] SCENTED CHRISTMAS TREE ORNAMENT

[76] Inventor: William E. Bychowski, 16 W. 038 Brookwood, Bensenville, Ill. 60106

[22] Filed: Nov. 13, 1974

[21] Appl. No.: 523,229

[52] U.S. Cl. ..... 239/57; 220/4 E; 428/11; 428/905

[51] Int. Cl.[2] ..... A47G 33/08

[58] Field of Search ..... 161/16, 18, 109, 110, 410; 215/218; 220/4 B, 4 E; 239/34, 53–60; 428/11, 13, 14, 131, 132, 905, 913

[56] References Cited

UNITED STATES PATENTS

| | | | |
|---|---|---|---|
| 2,475,450 | 7/1949 | Dvorak | 220/4 B X |
| 2,745,642 | 5/1956 | Hermann | 220/4 B X |
| 2,807,901 | 10/1957 | Gilowitz | 161/18 X |
| 2,858,955 | 11/1958 | Kroenert | 220/4 B |
| 2,973,558 | 3/1961 | Stratton, Jr. | 264/89 |
| 2,975,823 | 3/1961 | Ponnock | 156/245 |
| 3,556,916 | 1/1971 | Levey et al. | 161/410 X |
| 3,565,735 | 2/1971 | Burnbaum | 161/16 |
| 3,698,991 | 10/1972 | Susewitz | 161/14 |

*Primary Examiner*—George F. Lesmes
*Assistant Examiner*—Henry F. Epstein
*Attorney, Agent, or Firm*—Marden S. Gordon

[57] ABSTRACT

A scented Christmas tree ornament intended for support on Christmas trees of the live or artificial type and wherein the ornament consists of a top section and a bottom section which are detachably threaded together and which define a hollow compartment interiorly thereof, the side walls of the ornament being provided with a multiplicity of small holes and perforations in communication with the compartment, and with the bottom section having supported therein a pedestal type stand with a cup at the top thereof adapted to receive therein a capsule of pine-scented liquid with the capsule being broken so that the liquid is contained in the cup and with the pine scent thereof emanating through the compartment and out of the holes and perforations into the surrounding atmosphere to provide a natural pine scent to the surrounding atmosphere.

1 Claim, 5 Drawing Figures

SCENTED CHRISTMAS TREE ORNAMENT

BACKGROUND OF THE INVENTION

1. Field of the Invention

This invention relates generally to Christmas tree ornaments and more particularly to a novel and improved ornament intended to have a scent emitting liquid placed therein for providing a pleasing scent to the atmosphere about the tree on which the ornament is suspended in a home, office and the like.

2. Description of the Prior Art

The celebration of the Christmas season is universal throughout the country and foreign lands, with the Christmas tree being universally used at this time in the celebration of the Christmas season. However, due to the dangers associated with the use of normal pine trees inside a home and office or other structure, such as the danger of fire, along with the ecological aspect of not wishing to destroy trees merely for temporary decorative purposes in a home, there has in recent years become quite popular a complete range of artificial trees manufactured of metal and plastic materials for use during the Christmas season.

These artificial trees are becoming increasingly more popular every year due to the safety thereof, the ease of assembly and disassembly thereof, and their attractiveness in the home. However, while many people appreciate an enjoy such artificial trees, they miss the fresh and natural odors associated with a pine tree formerly used during the Christmas season, and as such while they would prefer to have an artificial tree due to its safety and convenience features, are still utilizing real trees during the Christmas season.

SUMMARY OF THE INVENTION

The present invention recognizes the advantages of artificial trees as well as recognizing that the main deficiency and disadvantage thereof is its lack of the fresh outdoors odor, such as a pine odor, and accordingly the present invention provides a novel solution thereto in the form of a decorative ornament intended to be suspended from the artificial tree and adapted to contain therein a scent producing device, such as a pine scented liquid, the scent emanating from the ornament to provide the desired odor about the tree and the immediate atmosphere simulating the odor which would be obtained if a real pine Christmas tree were utilized instead of the artificial tree.

It is a feature of the present invention to provide a scented Christmas tree ornament.

A further feature of the present invention provides a scented Christmas tree ornament which is relatively simple in its construction and which therefore may be readily manufactured at a relatively low cost and by simple manufacturing methods such that it can be retailed at a sufficiently low price to encourage widespread use thereof.

Still a further feature of the present invention provides a scented Christmas tree ornament which is possessed of few parts and which therefore is unlikely to get out of order.

Yet still a further feature of the present invention provides a scented Christmas tree ornament which is easy to use and reliable and efficient in operation.

Still yet a further feature of the present invention provides a scented Christmas tree ornament which is of a rugged and durable construction and which therefore may be guaranteed by the manufacturer to withstand many years of intended usage.

Yet still a further feature of the present invention provides a scented Christmas tree ornament which is aesthetically pleasing and refined in appearance.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENTS

Figure 1:
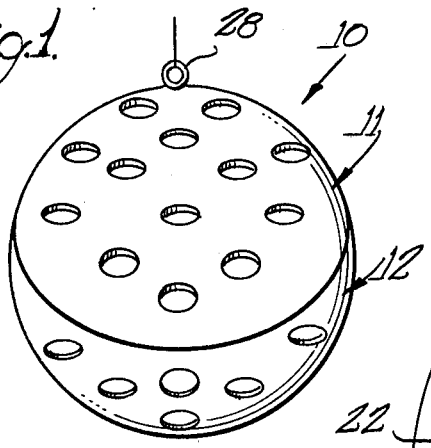
FIG. 1 is a perspective view of the Christmas tree ornament of the invention.
Figure 2:
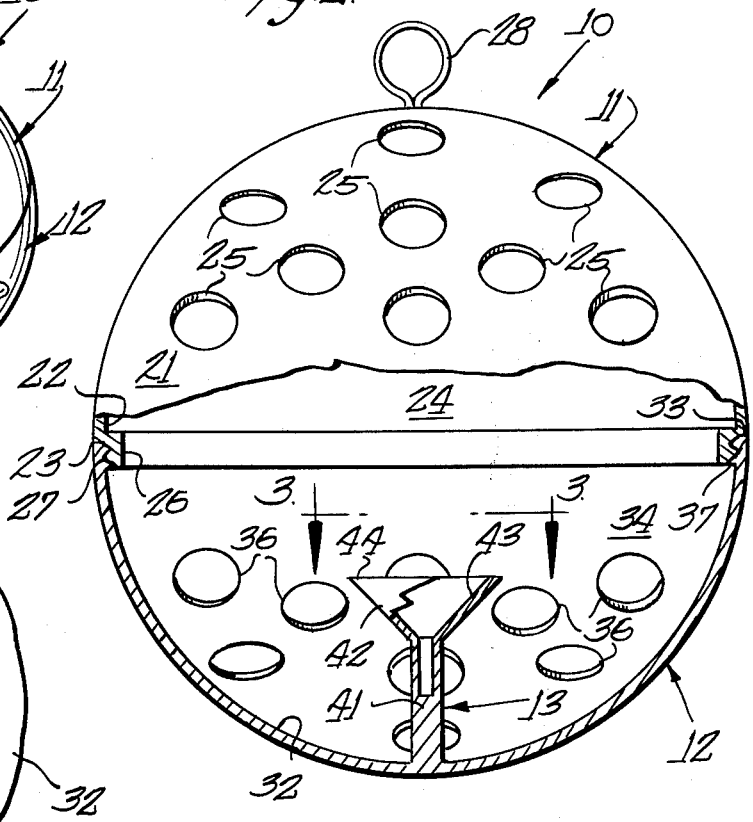
FIG. 2 is an enlarged fragmentary front plant view of the ornament which is partially broken away to illustrate interior details thereof.
Figure 3:
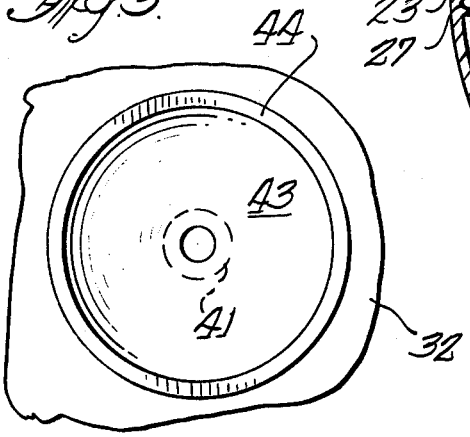
FIG. 3 is an enlarged top plan view taken along line 3—3 of FIG. 2.
Figure 4:
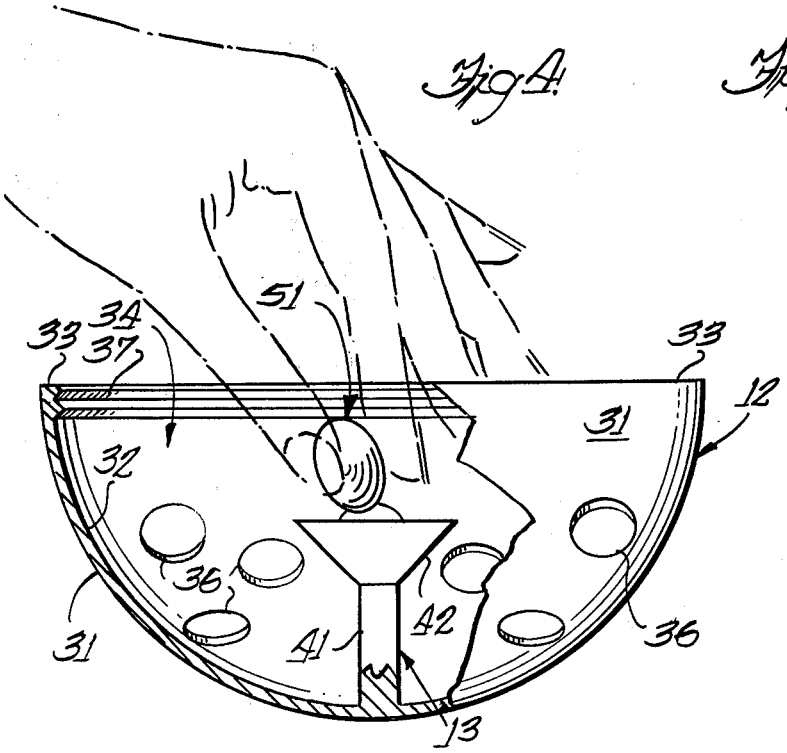
FIG. 4 is a fragmentary front elevational view of the bottom section of the ornament having a capsule of scenting liquid inserted into the pedestal cup.

Referring now to the drawings in detail and in particular to FIGS. 1 to 4 inclusive, a first preferred form of a scented Christmas tree ornament constructed in accordance with the principles of the present invention is designated generally in its entirety by the reference numeral 10 and is comprised generally of three component parts, namely a top member 11, a bottom member 12, and a pedestal 13 disposed inwardly of the bottom member.

The ornament 10 may be manufactured out of metal, wood, hard rubber, plastic, or any other suitable satisfactory material providing an aesthetically pleasing and refined appearance, with the preferred embodiment being manufactured of a high impact polystyrene plastic material which may be provided in a variety of decorative colors and patterns appealing to prospective purchasers.

The device 10 is of a spherical ball shape with the top and bottom members 11 and 12 each being of a hollow hemi-spherical configuration making up respective half portions of said ball shape.

Top member 11 is of a hemi-spherical hollow configuration having an exterior surface 21, an interior surface 22, a surrounding peripheral edge 23, a hemispherically shaped hollow interior compartment 24, and a plurality of holes and perforations 25 extending through the wall surfaces in communication with the compartment. Disposed integrally with peripheral edge 23 and forming an interior annular flange thereabout is flange member 26 which projects vertically downwardly from edge 23 and is spaced inwardly from the edge and has formed on its outer surface 27 a screw thread for use with bottom member 12 as will be later described.

Affixed to the topmost portion of top member 11 is a ring 28 projecting vertically upwardly therefrom and adapted to be supported on a branch of the Christmas tree (not shown) to hold the ornament 10 in a suspended manner relative thereto.

The bottom member 12 is of a hollow hemi-spherical shape identical to that of FIG. 11 and is provided with an exterior surface 31, an interior surface 32, peripheral terminal edges 33, a hollow hemi-spherically shaped compartment 34, and a plurality of holes and perforations 36 extending therethrough placing the compartment 34 in communication with the surrounding atmosphere. Disposed about the interior surface 32 adjacent edge 33 are screw threads 37 of a size and pitch adapted to be threadedly received on screw threads 27 of flange 26 of top member 11 for detachably threadedly connecting bottom member 12 to top member 11 to define the spherical ball shape of the device 10.

Disposed at the bottommost portion of the interior walls 32 and projecting radially inwardly therefrom is a cylindrical base 41 of the pedestal 13 which terminates at its top end in an inverted conically shaped cup member 42 having a chamber 43 formed integrally therewith and opening out of the top end 44 thereof.

The cup 42 with chamber 43 is adapted to receive therein a scented liquid which may be poured directly thereinto from a bottle or the like, or which is more often provided in a capsule form, such as the capsule designated generally by reference numeral 51, with the capsule being broken on its positioning in the chamber 43 to emit the scent of the liquid contained in the capsule.

In operation, bottom member 12 is unscrewed from top member 11, a capsule 51 of scented liquid, such as having a pine scent, is inserted into the chamber 43 of pedestal 13 and broken therein to release the liquid therefrom, the bottom member 12 is then rethreaded onto the top member 11 with the ornament 10 then being suspended from a branch of the Christmas tree to emit the scent from the capsule 51 to emanate from the joint compartment 24 and 34 out of the perforations 25 and 36 into the surrounding atmosphere to provide a pine scent thereabout.

It is to be noted that the longitudinal axis of pedestal 13 extends diametrically of the device 10 and intersects the longitudinal axis of the ring 28 such that when the device 10 is suspended from the Christmas tree the pedestal 13 is suspended in a vertical position.

Figure 5:
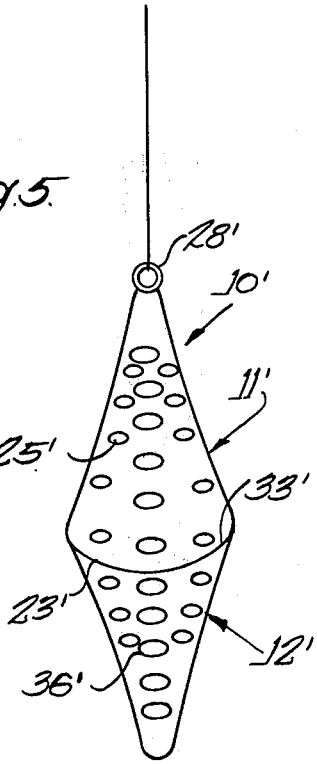
FIG. 5 is a perspective view of a modified form of the invention.

Referring now to FIG. 5 there is illustrated an alternative embodiment of the Christmas tree ornament which, for ease of reference, is designated generally by reference numeral 10'. Due to similarity between parts of the two embodiments of the invention, and in order to avoid needless repetition of description and illustration, similar reference numerals but having a single prime mark applied thereto have been utilized to identify the corresponding parts as between the disclosure of FIG. 5 and the disclosure of FIGS. 1–4.

The modified embodiment 10' is identical in structure and features to the embodiment 10 except that the top and bottom members 11' and 12' are of a conical configuration rather than a hemi-spherical configuration.

It is to be understood that the form of this invention herewith shown and described is to be taken as preferred examples of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. An ornament intended for use on a Christmas tree and adapted to receive an odor emitting substance therein, the ornament comprising, in combination:

a top member formed of a hollow hemi-spherically shaped body member including an interior surface, an exterior surface, and a peripheral surrounding bottom edge surface;

a hemi-spherically shaped compartment defined interiorally of said top member interior surface and opening out of a base thereof defined between said peripheral surrounding bottom edges;

a multitude of circular spaced apart perforations disposed in said top member body member placing said top member compartment in communication with the surrounding atmosphere;

a bottom member formed of a hollow hemi-spherically shaped body member of a size and configuration substantially identical to the size and configuration of said top member, said body member including an interior surface, an exterior surface, and a peripheral surrounding top edge surface;

a hemi-spherically shaped compartment defined interiorally of said bottom member interior wall and opening out of a base defined between said top peripheral edges;

a multitude of circular spaced apart perforations identical in size to the perforations in said top member and disposed in said bottom member body member placing said bottom member compartment in communication with the surrounding atmosphere;

an annular flange formed contiguous with said top member bottom edge and disposed radially inwardly therefrom and extending tangentially downwardly relative thereto, the flange having an inner surface in communication with said top member compartment, a bottom rim forming end surface, and an outer facing circumferal surface disposed radially inwardly from said body member bottom edge;

the radial inward spacing of said flange member relative to said top member exterior surface being equal to the wall thickness of said bottom member as defined between said bottom member interior and exterior surfaces;

screw threads disposed about said outer circumferal surface of said flange member extending completely between said top member bottom edge surface and said flange end rim surface;

screw threads disposed adjacent said bottom member top edge surface extending circumferally about said interior surface of said bottom member body member, said screw threads being of a size and pitch complementary to said screw threads formed on said top member flange member for threadedly receiving said bottom member attached to said top member in a manner providing for ease of assembly and disassembly of said bottom member to said top member;

an elongated cylindrically shaped base member having a top end and a bottom end, the bottom end formed integrally with said interior surface of said bottom member body member with the top end projecting radially outwardly therefrom into said bottom member compartment, the axis of the base member extending normal to a plane defined by said top edges of said bottom member;

an inverted conically shaped hollow cup formed integrally with said top end of said base member and opening outwardly therefrom;

a chamber defined inwardly of said inverted conical cup and opening out of the top end thereof;

an elongated hollow cylindrical chamber formed in said base member top end extending slightly inwardly of said base member and open at its top to be in communication with said conical cup chamber;

said conical cup chamber and said base member chamber adapted to receive a scented liquid therein;

a supporting ring affixed to said exterior surface of said top member body member at the vertex thereof and projecting outwardly therefrom, the longitudinal axis of said supporting ring being diametrically aligned with the longitudinal axis of said base member, said supporting ring adapted to retain said top member body member on a tree in a suspended manner therefrom;

said bottom member body member forming a continuous co-planar junction with said top member body member when said bottom member is threadedly affixed to said flange of said top member to provide a smooth continuous exterior surface for the ornament;

said top member body member, said bottom member body member, said base member, and said conical cup are each manufactured of a high impact polystyrene plastic material; and whereby said multitude of perforations in said top and bottom members permit the odor emanating from said scented liquid to pass from said top and bottom member compartments outwardly through said perforations and into the surrounding atmosphere.

* * * * *